US011287226B2

(12) United States Patent
Norris

(10) Patent No.: US 11,287,226 B2
(45) Date of Patent: Mar. 29, 2022

(54) SYSTEMS AND METHODS FOR NON-LETHAL, NEAR-RANGE DETAINMENT OF SUBJECTS

(71) Applicant: Wrap Technologies, Inc., Tempe, AZ (US)

(72) Inventor: Elwood Norris, Poway, CA (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

(21) Appl. No.: 17/146,342

(22) Filed: Jan. 11, 2021

(65) Prior Publication Data

US 2021/0156651 A1 May 27, 2021

Related U.S. Application Data

(63) Continuation of application No. 16/568,084, filed on Sep. 11, 2019, now Pat. No. 10,890,419, which is a continuation-in-part of application No. 16/167,920, filed on Oct. 23, 2018, now Pat. No. 10,551,152.

(60) Provisional application No. 62/729,684, filed on Sep. 11, 2018.

(51) Int. Cl.
*F41H 13/00* (2006.01)

(52) U.S. Cl.
CPC ..... *F41H 13/0006* (2013.01); *F41H 13/0025* (2013.01)

(58) Field of Classification Search
CPC ..... F41A 13/0006; F41H 13/0025
USPC ..... 102/502
See application file for complete search history.

(56) References Cited

U.S. PATENT DOCUMENTS

| | | | |
|---|---|---|---|
| 34,626 | A | 3/1862 | Ely |
| 34,628 | A | 3/1862 | Gault |
| 35,734 | A | 6/1862 | Gault |
| 39,282 | A | 7/1863 | Ganster |
| 271,825 | A | 2/1883 | Fiske |
| 347,988 | A | 8/1886 | Boyd |
| 495,505 | A | 4/1893 | Martin |
| 1,070,582 | A | 8/1913 | Browning |
| 1,151,070 | A | 8/1915 | Victory |

(Continued)

FOREIGN PATENT DOCUMENTS

| | | | |
|---|---|---|---|
| CA | 2162221 | A1 | 5/1996 |
| CN | 104085851 | A | 10/2014 |

(Continued)

*Primary Examiner* — Samir Abdosh
(74) *Attorney, Agent, or Firm* — Jason Jones

(57) ABSTRACT

A near-range launcher assembly for at least temporarily detaining a subject includes a primary launcher carrying a first projectile, the first projectile including a pair of pellets and a tether connecting the pellets. A secondary launcher is coupled to the primary launcher, the secondary launcher carrying a second projectile. At least one power source is associated with one or both of the primary and secondary launchers. At least one control system is operable to activate the power source. At least one user input is operable to communicate with the control system to activate the at least one power source to expel one or both of the first projectile and the second projectile from the launchers toward the subject. Each of the primary launcher and the secondary launcher carry an independent power source, such that each of the primary and secondary launchers can be independently initiated by a user.

12 Claims, 7 Drawing Sheets

(56) References Cited

U.S. PATENT DOCUMENTS 1,165,053 A 12/1915 Wodiska
1,198,035 A 9/1916 Huntington
1,211,001 A 1/1917 Steinmetz
1,217,415 A 2/1917 Colomyjczuk
1,229,421 A 6/1917 Downs
1,276,689 A 8/1918 Poudrier
1,304,857 A 5/1919 Davis
1,343,747 A 6/1920 Radakovich.
1,488,182 A 3/1924 Whelton
1,536,164 A 5/1925 Tainton
2,354,451 A 7/1944 Forbes
2,372,383 A 3/1945 Lee
2,373,363 A 4/1945 Wellcome
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
2,848,834 A 8/1958 Cox
3,085,510 A 4/1963 Campbell
3,340,642 A 9/1967 Vasiljevic
3,484,665 A 12/1969 Mountjoy et al.
3,523,538 A 8/1970 Shimizu
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,546,863 A 8/1996 Joslyn
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 * 1/2008 Su ..... F41B 11/62 102/502
7,327,549 B2 * 2/2008 Smith ..... F41H 13/0025 361/232
7,360,489 B1 * 4/2008 Han ..... F42B 10/56 102/444
D570,948 S 6/2008 Cerovic et al.
7,409,912 B2 * 8/2008 Cerovic ..... F41H 13/0018 102/502
7,412,975 B2 8/2008 Burton, Jr.
7,444,939 B2 11/2008 McNulty et al.
7,444,940 B2 11/2008 Kapeles et al.
D602,109 S 10/2009 Cerovic et al.
7,640,839 B2 * 1/2010 McNulty, Jr. ..... H05C 1/06 89/1.11
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
D651,679 S 1/2012 Klug et al.
8,096,076 B1 * 1/2012 Cerovic ..... F41H 13/0018 42/84
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,339,763 B2 12/2012 McNulty, Jr.
8,441,771 B2 5/2013 Hinz et al.
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 10/2014 Tseng
8,881,654 B2 11/2014 Seecamp
8,896,982 B2 11/2014 Beecher et al.
8,899,139 B2 12/2014 Brill et al.
9,025,304 B2 5/2015 Brundula et al.
D736,885 S 8/2015 Swan et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,435,619 B1 9/2016 Park
9,581,417 B2 2/2017 Tseng
9,638,498 B2 5/2017 Chang
D791,901 S 7/2017 Swan et al.
10,107,599 B2 10/2018 Norris et al.

(56) References Cited

U.S. PATENT DOCUMENTS 10,288,388 B1* 5/2019 Lavin ..... F41H 13/0025
10,634,461 B2 6/2020 Korneluk et al.
2002/0134365 A1 9/2002 Gray
2002/0170418 A1 11/2002 McNulty Jr. et al.
2003/0106415 A1 6/2003 Smith
2003/0165041 A1 9/2003 Stethem
2003/0165042 A1 9/2003 Stethem
2004/0245338 A1 12/2004 Poloniewicz
2005/0166441 A1 8/2005 Mattox
2006/0112574 A1 6/2006 Hodge et al.
2006/0120009 A1 6/2006 Chudy, II
2006/0254108 A1 11/2006 Park
2007/0019358 A1 1/2007 Kroll
2007/0070573 A1* 3/2007 Nerheim ..... F41H 13/0025 361/232
2007/0070574 A1* 3/2007 Nerheim ..... F41H 13/0018 361/232
2007/0079538 A1* 4/2007 Smith ..... F41H 13/0025 42/1.08
2007/0081292 A1* 4/2007 Brundula ..... H05C 1/06 361/232
2007/0081293 A1* 4/2007 Brundula ..... F41H 13/0025 361/232
2007/0101893 A1 5/2007 Shalev et al.
2007/0188972 A1* 8/2007 Nerheim ..... F41H 13/0025 361/262
2007/0264079 A1 11/2007 Martinez et al.
2008/0204965 A1* 8/2008 Brundula ..... F41H 13/0018 361/232
2008/0259520 A1* 10/2008 Brundula ..... F41H 13/0025 361/232
2009/0084284 A1 4/2009 Martinez et al.
2009/0323248 A1* 12/2009 Brundula ..... H05C 1/06 361/232
2010/0071678 A1 3/2010 Allen
2010/0126483 A1 5/2010 Makowski
2010/0315755 A1* 12/2010 Gavin ..... F41H 13/0025 361/232
2010/0315756 A1 12/2010 Gavin
2011/0005373 A1 1/2011 Martinez et al.
2011/0271825 A1 11/2011 Howland
2012/0019975 A1 1/2012 Hanchett et al.
2012/0170167 A1 7/2012 Beechey et al.
2012/0210904 A1 8/2012 Merems
2012/0257320 A1* 10/2012 Brundula ..... F41H 13/0018 361/232
2013/0208392 A1* 8/2013 Brundula ..... H05C 1/06 361/232
2014/0331984 A1 11/2014 Brahler, II et al.
2014/0334058 A1 11/2014 Galvan et al.
2015/0075073 A1 3/2015 Sylvester
2015/0168107 A1 6/2015 Tseng
2015/0241180 A1 8/2015 Pruett
2015/0276351 A1 10/2015 Pekarek et al.
2015/0316345 A1 11/2015 Brahler, II et al.
2016/0010949 A1 1/2016 Teetzel et al.
2016/0161225 A1 6/2016 Searle et al.
2016/0238350 A1 8/2016 Tseng
2017/0029816 A1 2/2017 Swiderski
2017/0160060 A1 6/2017 Purvis
2017/0241751 A1 8/2017 Nerheim
2017/0276461 A1 9/2017 Norris
2018/0003462 A1 1/2018 Chavez
2018/0292172 A1 10/2018 Ehrlich
2018/0372456 A1 12/2018 Norris
2019/0186872 A1* 6/2019 Salisbury ..... F41H 13/0025
2019/0186873 A1* 6/2019 Salisbury ..... F41H 13/0025
2019/0271772 A1* 9/2019 Nerheim ..... G01D 5/245
2020/0018583 A1 1/2020 Norris et al.
2020/0072584 A1 3/2020 Ozanne
2020/0096297 A1 3/2020 Norris
2020/0109924 A1* 4/2020 Goodchild ..... F41H 13/0031

FOREIGN PATENT DOCUMENTS

DE 3522661 A1 1/1987
GB 2386673 A 9/2003
JP 2011/106748 A 6/2011
RU 2186492 C2 8/2002
RU 2274823 C1 4/2006
RU 2410625 C2 1/2011

* cited by examiner

SYSTEMS AND METHODS FOR NON-LETHAL, NEAR-RANGE DETAINMENT OF SUBJECTS

PRIORITY CLAIM

This application is a continuation of U.S. patent application Ser. No. 16/568,084, filed Sep. 9, 2019, which claims priority of and to U.S. Provisional Patent Application Ser. No. 62/729,684, filed Sep. 11, 2018, and which is a continuation-in-part of U.S. patent application Ser. No. 16/167,920, filed Oct. 23, 2018, all of which are hereby incorporated herein by reference in their entirety.

RELATED APPLICATIONS

The present application is related to U.S. patent application Ser. No. 15/081,440, filed Mar. 25, 2016, which is hereby incorporated herein by reference in its entirety.

BACKGROUND OF THE INVENTION

Field of the Invention

The present invention relates generally to non-lethal, near-range weapons systems to aid in temporarily detaining, immobilizing, impeding or subduing hostile or fleeing subjects.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to address a situation without resorting to use of a firearm. It is generally accepted, however, that engaging in hand-to-hand combat is not a desirable alternative.

For at least these reasons, several near-range, non-lethal devices have been developed to provide an alternative approach to dealing with hostile or fleeing subjects. While the addition of these options has been found useful by military and law enforcement personnel, such personnel may now be provided with so many options that efficiently carrying multiple devices can prove burdensome. In addition, having to choose which device to deploy in any given circumstance can be troublesome.

SUMMARY OF THE INVENTION

In accordance with one aspect of the invention, a near-range launcher assembly for at least temporarily detaining a subject is provided, including a primary launcher carrying a first projectile, the first projectile including a pair of pellets and a tether connecting the pellets. The first projectile can be capable of at least temporarily detaining a subject. A secondary launcher can be coupled to the primary launcher, the secondary launcher carrying a second projectile. The second projectile can be capable of at least temporarily detaining the subject. At least one power source can be associated with one or both of the primary and secondary launchers. At least one control system can be operably coupled to the at least one power source, the control system operable to activate the power source. At least one user input can be operably coupled to the at least one control system. The user input can be operable to communicate with the control system to activate the at least one power source to expel one or both of the first projectile and the second projectile from the launchers toward the subject.

In accordance with another aspect of the technology, a near-range launcher assembly for at least temporarily detaining a subject is provided, including a frame and a primary launcher carried by the frame. The primary launcher can carry a first projectile, the first projectile including a pair of pellets and a tether connecting the pellets. The first projectile can be capable of at least temporarily detaining a subject. A secondary launcher can be carried by the frame, the secondary launcher carrying a second projectile. The second projectile can be capable of at least temporarily detaining the subject. At least one power source can be associated with the frame or with one or both of the primary and secondary launchers. At least one control system can be operably coupled to the at least one power source, the control system operable to activate the power source. At least one user input can be operably coupled to the frame and to the at least one control system. The user input can be operable to communicate with the control system based on input from the user to activate the at least one power source to expel one or both of the first projectile and the second projectile from the launchers toward the subject.

In accordance with another aspect of the invention, a method of temporarily detaining a subject is provided, including: wielding a near-range launcher assembly that includes: a primary launcher carrying a first projectile, the first projectile including a pair of pellets and a tether connecting the pellets, the first projectile being capable of at least temporarily detaining a subject; a secondary launcher coupled to the primary launcher, the secondary launcher carrying a second projectile, the second projectile being capable of at least temporarily detaining a subject; at least one power source, associated with one or both of the primary and secondary launchers; and at least one control system, operably coupled to the at least one power source, the control system operable to activate the power source. The method can include determining a threat level posed by the subject. Based on the threat level, the method can include selecting either the primary or the secondary launcher, and engaging a user input interface of the assembly to communicate with the control system to activate the at least one power source to expel the first projectile or the second projectile from the launcher assembly toward the subject.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
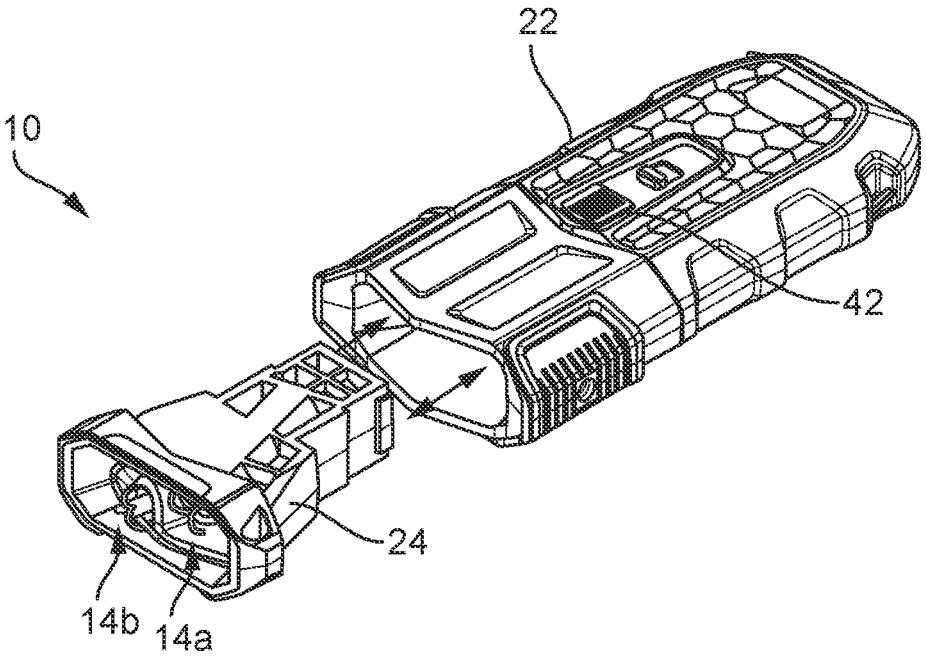
FIG. 1 is a top perspective view of a near-range launcher in accordance with an aspect of the present invention, shown in an exploded condition with a projectile casing being removed from or installed in the device.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a projectile" can include one or more of such projectiles, if the context dictates.

As used herein, the terms "firearm blank" or "blank cartridge" refer to the well-known blank cartridge that can be used with firearms. Such blank cartridges contain gunpowder but not a bullet or shot: as such, they can be discharged to produce only a high velocity pressure wave, without an accompanying shot or slug.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to non-lethal, near-range weapons systems that can be effectively used as an aid in impeding the progress of or detaining aggressive or fleeing subjects. Devices in accordance with the present technology can be advantageously used to temporarily impede a subject's ability to stand, walk, run, or use his or her arms. These options can be beneficial in cases where law enforcement, security personnel or military personnel wish to detain a subject, but do not wish to use lethal or harmful force or to engage in close proximity, hand-to-hand combat.

In some embodiments, the present technology advantageously provides to a user multiple choices for engaging a subject who may be fleeing, attacking, or who is otherwise deemed necessary of restraint. In particular, at least two manners of detaining a subject can be provided, each with varying levels of force response. In one aspect of the invention, two launchers are provided in an assembly that presents to the user a unitary interface, enabling the user to easily wield and/or holster the assembly as a single unit. Once wielded for use, the user can easily choose between one or both launchers for any particular situation.

Figure 2:
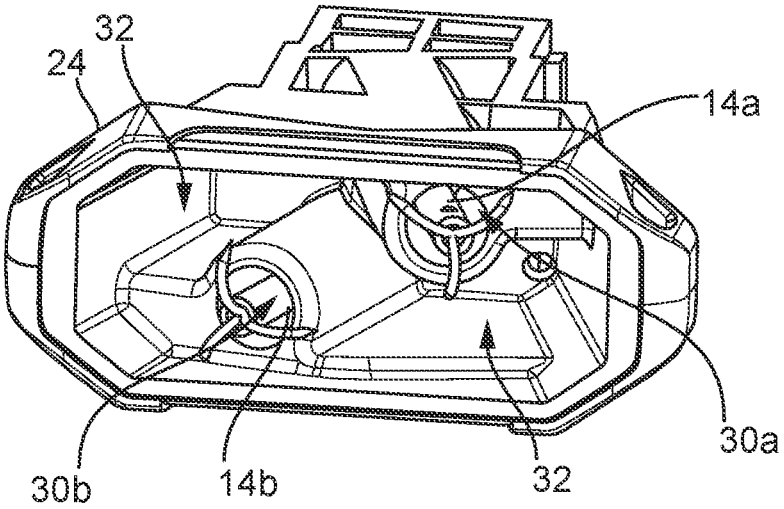
FIG. 2 is a front view of the projectile casing of FIG. 1.
Figure 3:
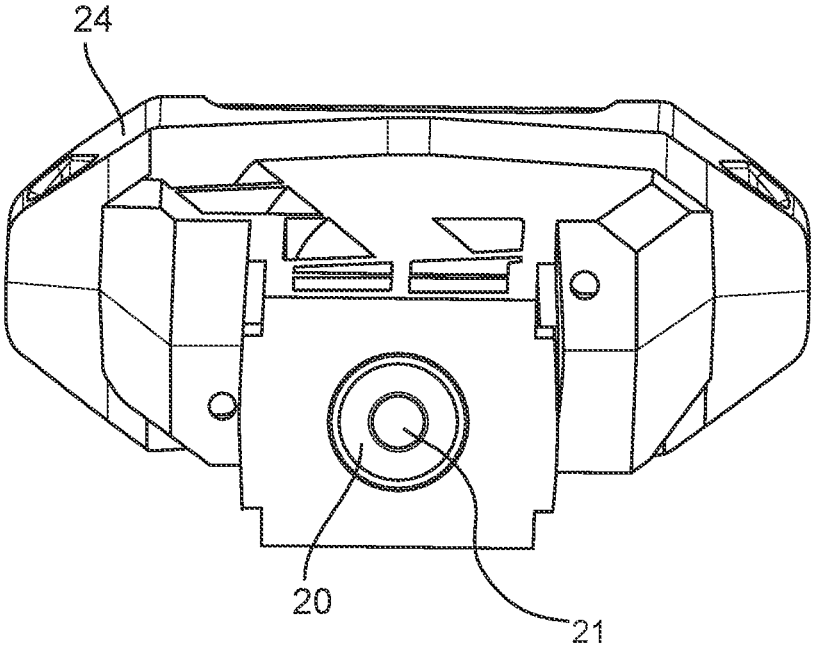
FIG. 3 is a rear view of the projectile casing of FIG. 1.

FIGS. 1 through 3 illustrate one exemplary primary launcher 10 that can be used in accordance with the present technology. This launcher is used to expel an entangling projectile toward a subject: after contacting the subject, the entangling projectile wraps about arms or legs of the subject to temporarily restrain or subdue the subject. The launcher 10 is similar in operation and design as those disclosed in patents and patent applications to the present inventor, such as U.S. Pat. No. 10,036,615, U.S. patent application Ser. Nos. 15/399,537 and 15/467,958, all of which are hereby incorporated herein by reference in their entirety. These patents and publications provide additional information about some of the launchers discussed herein.

In the example shown, launcher 10 generally includes an entangling projectile that includes a pair of pellets 14*a*, 14*b*, and a tether connecting the pellets. Portions of one exemplary tether are shown at 16 in FIG. 6. Note that the tether will generally connect the pellets as a continuous structure between the two pellets—the example shown omits much of the tether to enable a dearer description of other components. A projectile casing 24 can be provided that can include a pair of sockets 30*a*, 30*b* (see FIG. 2, for example). Each socket can be sized and shaped to carry one of the pair of pellets: in the examples shown, socket 30*a* carries pellet 14*a* and socket 30*b* carries pellet 14*b*.

The projectile casing 24 can include a selectively activatable power source or pressure source 20 (FIG. 3). The pressure source can be capable of expelling the entangling projectile from the projectile casing toward a subject. The system can also include a launcher body 22 that can carry a control system (shown schematically at 48 in FIG. 4A) that can be operable to activate the pressure source to expel the entangling projectile from the projectile casing toward the subject.

While not so required, the projectile casing 24 can be removably engageable with the launcher body 22 to allow removal of the projectile casing from the launcher after expulsion of the entangling projectile from the projectile casing. In the example shown, launcher 10 includes a user input interface, or in this case a trigger 42, that is in communication with a control system, shown generically in FIG. 4A at 48. The control system is in turn in communication with the power or pressure source (20 in FIG. 3), Generally, activation of the user input, or trigger, causes the control system to activate the pressure or power source, which results in expulsion of the entangling projectile from the casing 24, and thus from the launcher body 22.

In this example, once the projectile has been deployed from a particular projectile casing, that casing can be removed and a fresh projectile casing with a preinstalled entangling projectile and pressure or power source can be installed within the launcher. Activation of a first casing and replacement with a fresh casing can be achieved in a matter of seconds. Thus, law enforcement, security, military, etc., personnel can very rapidly exchange a spent projectile casing with a fresh projectile casing that is loaded and ready for activation by the launcher.

FIG. 2 illustrates a front view of the casing 24. In this view, pellets 14*a*, 14*b* can be seen stored, ready for use, in sockets 30*a*, 30*b*, respectively. One or more tether storage compartments 32 can be provided and can consist of shaped depressions formed in the projectile casing to allow the tether (not shown in this view) to be stored adjacent the pellets prior to use.

In the example shown in FIGS. 1-3, the power or pressure source 20 comprises a cartridge blank. This type of pressure source is well known to contain gunpowder that is typically activated by initiating a primer formed in the cartridge. The blank cartridge contains no slug; deployment of the cartridge results only in a high-pressure wave being directed from the projectile casing. This high-pressure wave is utilized by the present technology to propel the entangling projectile from the system at high velocity. In one embodiment of the invention, the cartridge blank can be irremovably attached to the cartridge such that the cartridge is a single actuation cartridge. In this manner, installation of the cartridge can be done in a controlled manufacturing environment, to ensure the proper cartridge is used, that the cartridge is properly installed, and that the casing 24 is otherwise ready for use. The cartridge can be secured to the casing by adhesive, mechanical crimp, etc.

Figure 4A:
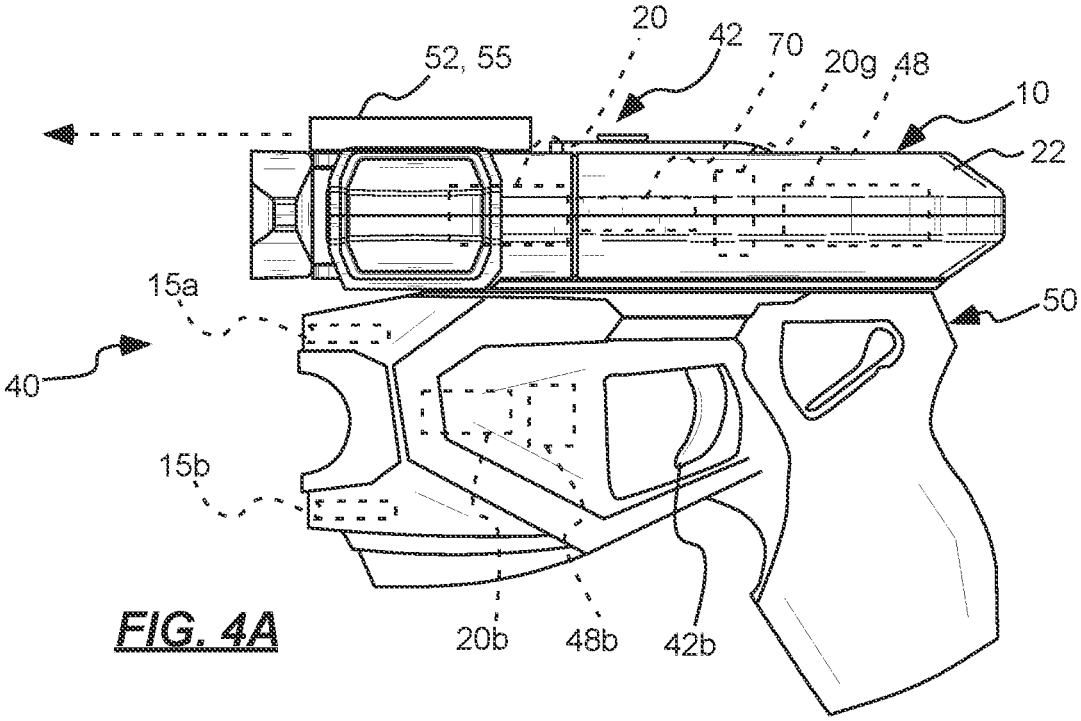
FIG. 4A is a side view of an exemplary near-range launcher assembly in accordance with an embodiment of the invention.
Figure 4B:
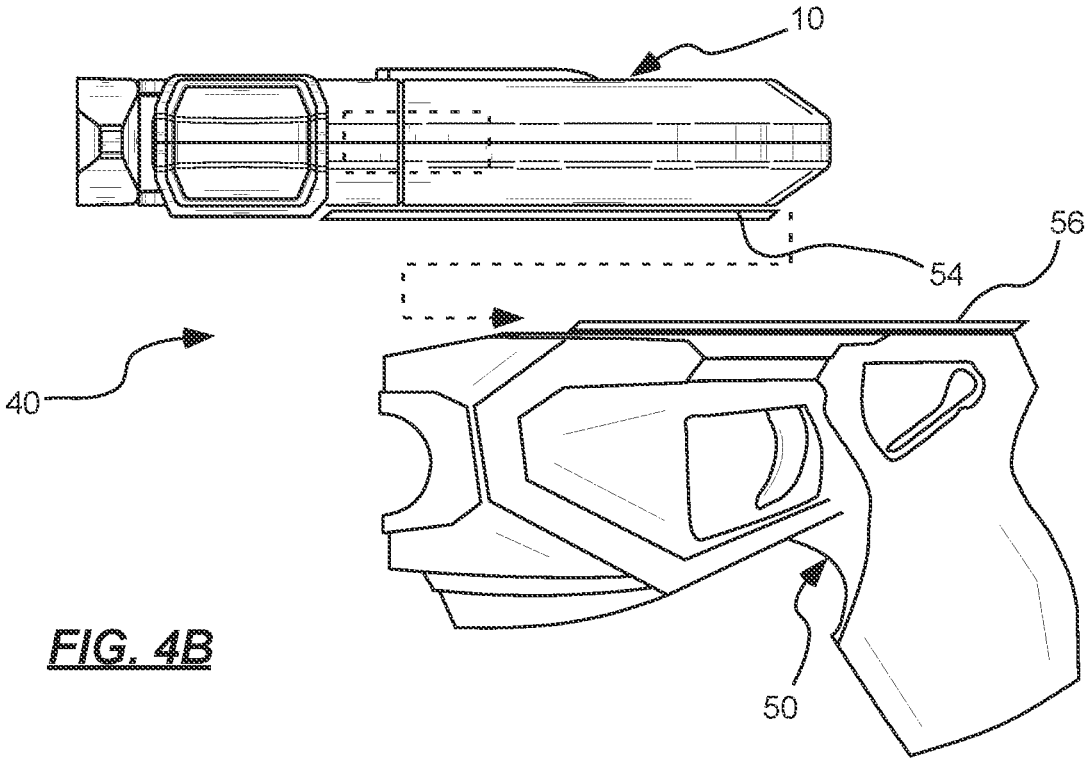
FIG. 4B is a side view of the assembly of FIG. 4A, shown with a primary launcher being attached to a secondary launcher.

FIGS. 4A and 4B illustrate an embodiment of the invention in which the launcher 10 is one of two launchers provided in a launcher assembly. In this example, launcher assembly 40 can include a primary launcher 10 that can carry a first projectile that can include a pair of pellets (14*a* and 14*b* in FIGS. 1 and 2) and a tether (not shown in this figure) connecting the pellets. The first projectile is capable of at least temporarily detaining a subject. A secondary launcher 50 can be coupled to or carried by or integrated with the primary launcher. The secondary launcher can carry a second projectile, shown schematically in FIG. 4A having electrodes 15*a* and 15*b*. The second projectile can be capable of at least temporarily detaining a subject when the electrodes make contact with the subject.

The overall system can include at least one power source, however two are shown in this example, power or pressure source 20 associated with launcher 10 and power source 20*b*, shown schematically in FIG. 4A, associated with launcher 50. At least one control system can be operably coupled to the at least one power source, the control system operable to activate the power source. While the system can utilize a single control system, the example shown in FIG. 4A includes two: control system 48 associated with launcher 10 and control system 48*b* associated with launcher 50.

The system 40 can include at least one user input that can be operably coupled to the at least one control system, the user put operable to communicate with the control system to activate the at least one power source to expel one or both of the first projectile and the second projectile from the launchers toward the subject. In the example shown, two user inputs are shown: input 42 associated with launcher 10 and input 42*b* associated with launcher 50. Input 42 is in communication with control system 48, which is in turn in communication with power source 20 (FIG. 3). Input 42*b* is in communication with control system 48*b*, which is in turn in communication with power source 20*b*.

The system can optionally include sight 52, which can generate one or more optical beams (e.g., lasers) to aid in aiming the system 40. The sight 52 can generate a single beam to aid in aiming the system, or the sight can be configured to generate a separate, differing beam for each launcher. Alternately, a second sight can be provided to generate a separate sighting beam for each launcher. This can be advantageous for a number of reasons. For example, as the primary launcher is typically designed to be targeted such that the projectile wraps about a subject's arms or legs, some sights generate a targeting pattern that appears to a user as a beam or a cross. This can be more easily used to target a subject with the projectile launcher. Also, a user may generally aim the primary launcher differently than the secondary launcher. Thus, activation of the light beam of the sight can, where desired, generate two differing aiming patterns, and/or two differing aiming locations. In one embodiment, the two differing sight beams can be differently colored (e.g., one green laser and one a red laser) to aid the user in distinguishing between the two. In another embodiment, the two differing sight beams can be of a different pattern, with one provided having a noticeable width (e.g., a "beam") and one provided as a point target on the subject.

This aspect of the invention can be advantageous in that a user can easily determine, by visually inspecting the pattern generated on the subject, which of the primary or secondary launchers is active and ready to fire. This can help prevent accidental use of one launcher instead of the other.

The sight component can also include a range finder or distance measurer 55. The range finder determine how far the subject is from the launcher assembly. This information can be used in a number of manners. In one aspect, either or both launchers can be configured to only fire when the subject is within a predetermined distance range. In particular, the primary launcher, or projectile launcher, can be prevented from firing if the subject is closer than about eight feet. The present inventors have found that the projectile generally does not have enough room to reach full extension if the subject is closer than about eight feet to the launcher. Similarly, either or both the primary and secondary launchers can be disabled if the subject is too far from the user.

Thus, in the example shown, each of the primary launcher 10 and the secondary launcher 50 include all components necessary to individually operate each of the launchers. Where desired, however, a central user input can be adopted to allow the user to control either launcher, as is desired. Additionally, a central control system can be incorporated, as can a central power source.

The primary 10 and secondary 50 launchers can be associated with one another in a variety of ways. In one aspect of the invention, the primary and secondary launchers are removably coupled one to another. FIG. 4B illustrates one exemplary manner in which the two can be coupled to one another. In this example, a rail 54 can be associated with the primary launcher 10 and a rail 56 can be associated with the secondary launcher 50. Rail 54 can be slidably received within (or about) rail 56, allowing an operator to relatively easily couple and uncouple the two from one another. Thus, an operator can quickly and easily replace, reload, clean or otherwise manipulate either or both the launchers, after which the launchers can quickly be re-coupled into the assembly shown.

Figure 5:
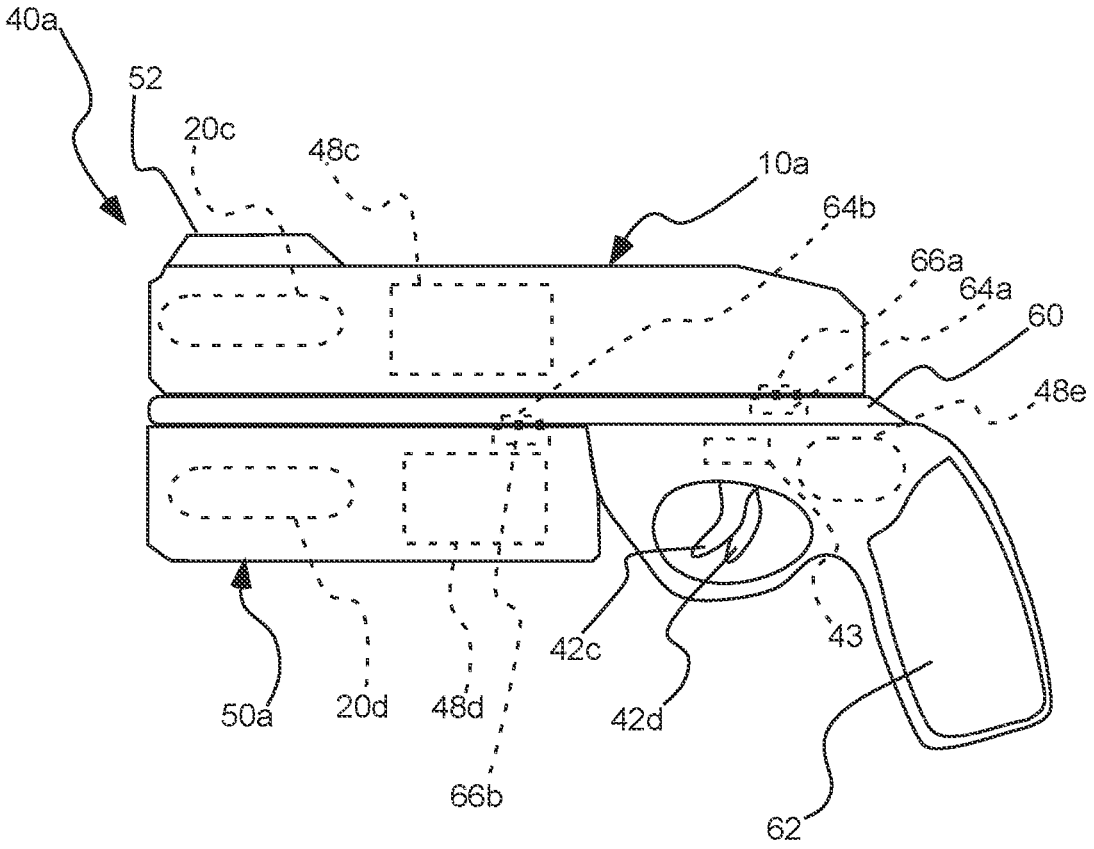
FIG. 5 is a side view of another exemplary near-range launcher assembly in accordance with an embodiment of the invention.

In another aspect of the invention shown in FIG. 5, a primary launcher 10*a* and a secondary launcher 50*a* can be integrated into a single frame 60. In this arrangement, the launchers can be permanently attached to the frame and only the cartridges carrying the projectiles of each launcher can be removable and reloadable.

The secondary launcher can take a variety of forms. However, in one embodiment, the secondary launcher can comprise a conducted energy weapon, or a "CEW," or electroshock weapon. In such known devices, a pair of electrodes (shown schematically at 15*a*, 15*b* in FIG. 4A) are propelled toward a subject and driven into contact with the subject's skin. The electrodes remain connected to a power source carried by the launcher 50: this power source then delivers a current through the electrodes and into the subject. Once so affected, the subject experiences "neuromuscular incapacitation," resulting in the subject being unable to flee or fight. Such CEWs are well known in the art: as such, many details are omitted herein that relate to the structure and function of such devices. One of ordinary skill in the art, having possession of this disclosure, will readily understand the operation and function of the CEW devices discussed herein, as incorporated into the present technology.

The assembly 40, 40*a* provides a manner in which a user, e.g., a law enforcement or military personnel, can be provided with a compact, non-lethal solution to detaining or restraining subjects that allows the user to choose which response is best. The compact design allows users to carry the assembly on his or her duty belt without consuming much more room than a single weapon would typically consume. The resulting weapon can also be made lighter than two individual weapons.

Advantageously, the primary and secondary launchers can be designed to address a hostile or fleeing subject in differing manners and with differing levels of force. Generally speaking, use of the entangling projectile having pellets 14*a*, 14*b* provides engagement with a subject at a lower level of force: as the projectile immobilizes the subject by tightly wrapping his or her arms, the risk of physical trauma is very low. While CEW weapons have been used with a great deal of success, the subject experiences both physical trauma and mental trauma when subjected to the electrical current flowing through the electrodes and his or her muscles.

Thus, an operator can, where desirable, first engage a subject with the entangling projectiles of the primary launcher. If this solution proves inadequate, or fails to subdue or retain the subject, the user can then deploy the CEW with the secondary launcher. Furthermore, the situation in which the user finds him- or herself, the clothing being worn by the subject, the surrounding environment, the weather, etc., all may dictate that one type of restraint is more desirable than the other. The user, having drawn and wielded only the single assembly 40, can quickly decide which launcher response is most desirable and quickly deploy the best choice. All of this can be accomplished without resorting to re-drawing another weapon, or having had to decide which weapon to initially draw.

In the embodiment of FIG. 5, frame 60 is provided having a handle 62. A pair of launchers, 10*a* and 50*a* can be coupled to or carried by the frame 60. While not so required, neither of the launchers may be operable individually, instead only becoming operable once attached to the frame. The frame can include communication ports 64*a*, 64*b*. These ports can communicate with corresponding communication ports 66*a*, 66*b* carried by launchers 10*a*, 50*a*, respectively. Thus, once the launchers are installed on the frame, user inputs 42*c*, 42*d* can be placed into communication with control systems 48*c*, 48*d*, which are in turn in communication with power sources 20*c*, 20*d*, respectively. In one example, an operator can activate user input 42*c*, 42*d* to launch projectiles from either the primary 10*a* or the secondary launcher 50*a*.

In one embodiment, the system can employ one user input 42*c* along with a selector switch or slider (shown schematically at 43 in FIG. 5). The selector switch can allow the user to select a safety mode where neither launcher will activate if input 42*c* is activated. The selector switch can also be positioned to activate one of the one or more control systems such that the user input 42*c* then activates either the primary launcher or secondary launcher, as selected by the user. The selector switch can be color coded, either statically or by a light indicator, to clearly indicate to the user which launcher is active.

The selector switch can optionally activate sight 52, which can generate an optical beam (e.g., laser) to aid in aiming the system 40*a*. When the selector switch is activated off of the safety position it can also activate the sight to avoid the necessity of having a separate on/off switch on the sight. In this manner, the sight serves as an indicator of the readiness status of the weapon: if a user perceives that the sight is activated, then the user knows the weapon is ready to fire.

In one example, individual control systems 48*c* and 48*d* can be omitted, and a central control system 48*e* can be carried by the frame 60. The central control system can communicate, via ports 64*a*, 64*b*, with power sources 20*c*, 20*d* to activate the power sources and launch projectiles from the respective launchers. This aspect of the invention can be advantageous in that the size of each launcher can be reduced relative to the size of each launcher individually, resulting in a more streamlined, lighter assembly 40*a*.

The central control system, or a central power source, can allow for differing levels of output to each launcher. Typically, the primary launcher as described herein requires a velocity of about 500 feet per second ("fps") to about 900 fps, whereas the secondary launcher may require a different or lower velocity output. For example, a CEW electrode generally requires a lower velocity of around 125 to 225 fps. Where the central power source comprises a gas charge, a central storage tank could power both launchers using a separate, differently-sized valve or release mechanism to allow the velocity to be adjusted as desired. The central storage tank can contain sufficient pressure to activate multiple deployments and the storage tank could also be ejectable and rapidly replaced by the user.

The power source of the primary and the secondary launcher may be the same central power source or each may have its own power source. Blank firearm cartridges may be used along with a variety of other power sources. These can include, without limitation, $CO_2$ cartridges, compressed air systems, spring-loaded assemblies, mechanical drive systems utilizing magnets, and the like. All suitable power sources capable of generating a suitable pressure wave, or projectile velocity, and directing that pressure wave into the projectile casing, or propelling the projectile through the casing, are suitable for use with the present technology. In addition, where the power source required for a particular launcher configuration is electric, the power sources discussed herein can be any of a variety of electrical potential storage devices, such as batteries, capacitors, etc.

While the examples illustrated herein include two launchers, the system can include additional launchers such that the device is capable of deploying multiple primary and secondary launchers without reloading. In addition, where desirable, the system can include two of the same type of launcher: e.g., two primary launchers that can be stacked one atop another.

Generally, the entangling projectiles of the present technology are provided as electrically inert. That is, they are not attached to an electrical charge source, nor do they require an electrical charge to subdue or entangle a subject. As used herein, the term "electrically inert" is understood to refer to a condition in which the projectiles, and pellets and tether, do not carry an electrical charge other than that carried by inert objects within the environment in which the projectiles are deployed. Thus, while some static charge may be carried by most objects in such an environment, the projectiles (pellets and tether) do not carry any additional charge. In most embodiments, the tether and pellets similarly need not carry any other structure capable of delivering an electrical charge to a subject. In contrast, the secondary launchers described herein typically require a hard connection to the launcher, as the electrodes must be connected to a current source. Thus, the primary launchers may differ from the secondary launchers in a number of manners, as would be appreciated by one of ordinary skill in the art having possession of this disclosure.

Figure 6:
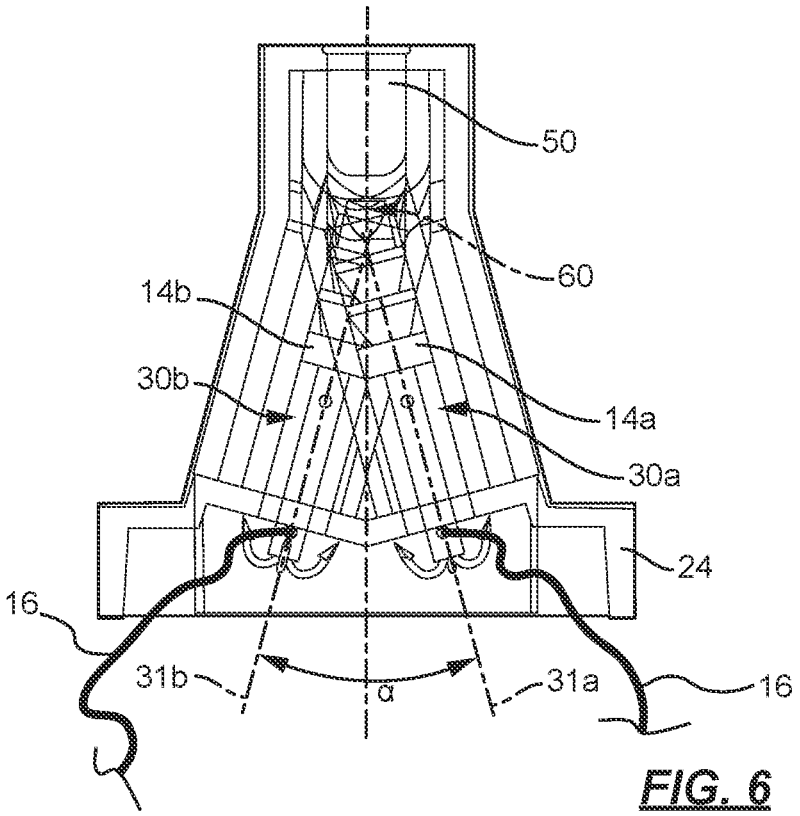
FIG. 6 is a top, partially sectioned view of the projectile casing of FIGS. 1 and 2.
Figure 7:
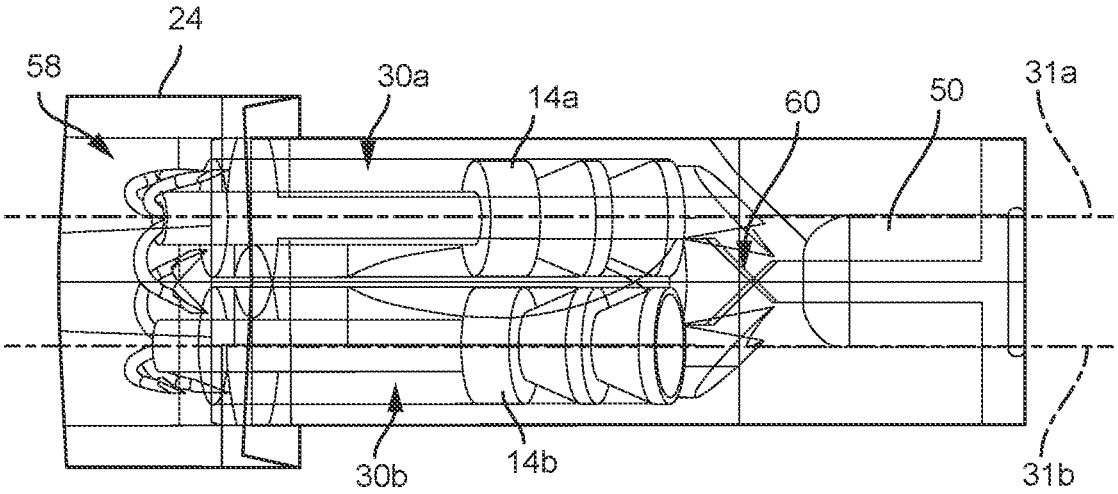
FIG. 7 is a side, partially sectioned view of the projectile casings of FIGS. 1 and 2.

FIGS. 6 and 7 illustrate further detail of the projectile casing 24. As discussed, each of socket 30*a*, 30*b* can hold one pellet, 14*a*, 14*b*, respectively, prior to deployment of the pellets from the projectile casing. As a high-pressure wave is generated by the cartridge (in this embodiment), it is directed through a central bore and is applied to the pellets held in sockets 30*a*, 30*b*. The pellets are then forcibly expelled from the inner block toward the subject.

As best appreciated from FIG. 6, the sockets 30*a*, 30*b* can be oriented at an angle "α" relative to one another. While the angle can vary, it is generally an acute angle, typically ranging from about 10 degrees to about 60 degrees. In another embodiment, the angle can range between about 25 degrees to about 45 degrees. In another embodiment, the angle is about 30 degrees. By angling the sockets relative to one another, the pellets 14*a*, 14*b* are directed away from one another as they are expelled from the sockets. In this manner, the pellets separate relative to one another very quickly, pulling the tether (not shown) taut between them so that the tether can fully extend prior to engaging the subject. The forward energy applied to the pellets is both split between the two pellets and angled by the nature of the sockets: as such, in the event that a pellet inadvertently directly contacts a subject, the force is less than that otherwise applied by a full charge, minimizing the risk of injury to the subject.

Generally, prior to contacting a subject, the tether will have been pulled taut between the pellets, such that the pellets 14 are travelling in a linear direction toward the subject. Immediately after the tether contacts the subject, the momentum of the pellets, prevented by the tether from continuing along their present trajectory, causes them to begin moving toward one another, which momentum will cause the pellets to orbit about the subject.

As the pellets orbit about the subject's legs, the tether wraps itself tightly about the subject's legs. Note that, as the tether wraps about the subject's legs, the rotational velocity of the pellets will increase, causing them to wrap more quickly as the effective length of the tether is decreased. In an average deployment, the pellets will wrap themselves about the subject's legs 2-3 times, resulting in the tether being wrapped about the subject's legs 4-6 times. As will be appreciated, a subject will at least temporarily have great difficulty moving after the tether is thus wrapped about his or her legs.

Referring again to FIG. 6, in this example axes 31*a*, 31*b* of the sockets 30*a*, 30*b*, respectively, can intersect one another at a location within the casing 24. That is, a portion or section of one of the sockets can intersect with a portion or section of the other socket within the confines of the casing. In the example shown, sockets 30*a* and 30*b* intersect or overlap where each socket is fluidly coupled to a central bore 60. The sockets can also be stacked horizontally relative to one another, to provide an overlapping configuration of one atop the other. In this manner, the sockets can be spaced relatively close to one another while also maintaining a desired angle between the two. The location at which the sockets intersect can be adjusted nearer to or further from the central bore.

This stacking/overlap configuration allows the use of a relatively narrow projectile casing 24 regardless of the angle at which it is desired to orient the sockets. If the sockets were merely oriented in a side-by-side relationship, without overlapping axes, the width or diameter of the projectile casing would have to be increased as the angle "α" between the socket axes 31 was increased. By overlapping the axes, however, this limitation in arranging the sockets is eliminated. This can allow the projectile casing to be much more narrow than otherwise possible. This results in a launcher system that can be easily carried by law enforcement personnel, similar to conventional firearms or Taser. While not so limited, in one aspect of the invention, the projectile casing 24 can be formed having a diameter or maximum width of less than about two inches (5.1 cm), and as little as 1½ inches (3.8 cm) or less. The projectile casing can be formed with a length of less than about 2½ inches (6.4 cm), or as little as two inches (5.1 cm) or less. Overlapping or stacking of the sockets also allows a vertical displacement of the pellets to differ as the pellets contact the subject. This vertical offset of the pellets is discussed in more detail in the parent applications referenced above.

Figure 8:
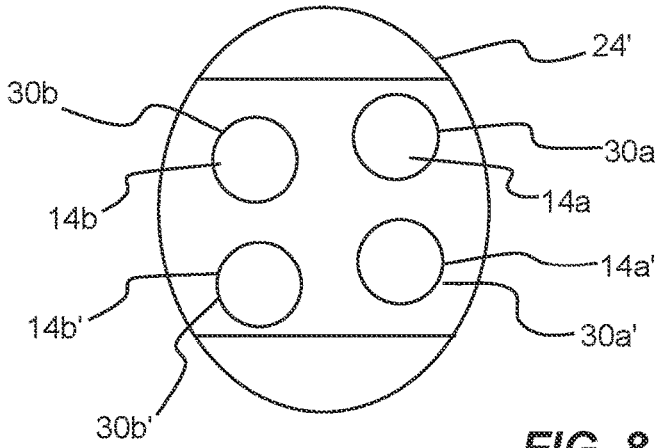
FIG. 8 is a schematic, front view of a projectile casing in accordance with another embodiment of the invention.
Figure 9:
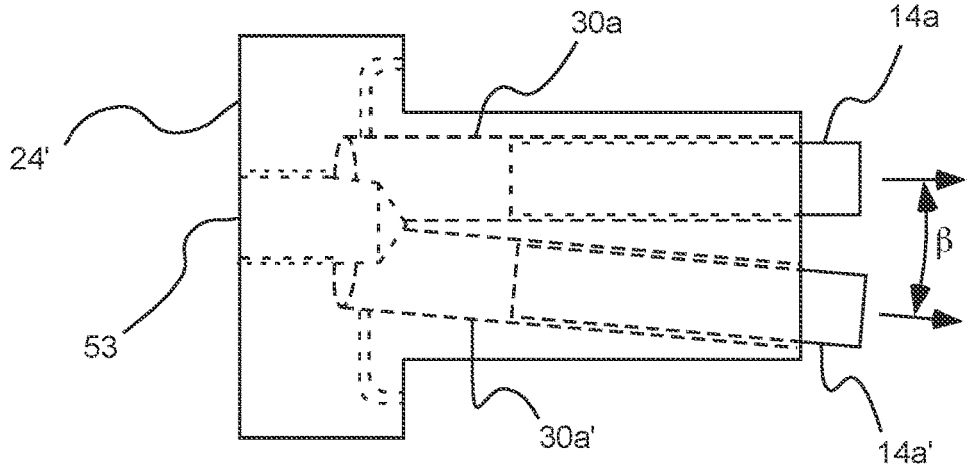
FIG. 9 is a side view of the casing of FIG. 8.

FIGS. 8 and 9 illustrate an alternate projectile casing, shown schematically as having a rounded cross section, where such might be advantageous. In this embodiment of the technology, four sockets, 30*a*, 30*b*, 30*a*' and 30*b*' are formed in a projectile casing or block 24'. As shown in FIG. 9, the upper sockets 30*a*, 30*b* carrying pellets 14*a*, 14*b* are directed forwardly of the block, while lower sockets 30*a*', 30*b*' carrying pellets 14*a*', 14*b*' are angled relative to the upper sockets by angle "β." In this embodiment, aiming a launcher that contains block 24' toward a target can result in directing one projectile including pellets 14*a*, 14*b* toward a subject's torso, while a second projectile including pellets 14*a*', 14*b*' is directed toward the subject's legs. This arrangement can allow law enforcement personnel to direct the launcher toward a subject's body mass, with the upper pair of pellets thereby being directed toward a subject's arms and the lower pair of pellets thereby being directed toward the subject's legs. As many law enforcement personnel are trained to direct fire at a subject's torso rather than the subject's legs, this may ensure that the projectile launcher is properly utilized by law enforcement. The angle "β" can vary, but the present inventors have found that as little as 6 degrees is sufficient to cause two projectiles to contact a subject's body in different areas.

In the embodiment shown in FIGS. 8 and 9, channel 53 provides fluid communication to all four sockets 30*a*, 30*b*, 30*a*' and 30*b*'. Thus, activation of the energy source 20 (not shown in these figures) results in both projectiles being expelled from the casing or block 24'. It is to be understood, however, that the system can be configured to provide a pressure wave to the upper sockets independently of the lower sockets, to allow, for example, law enforcement personnel to select which projectile to deploy. Likewise a casing or block can contain more than two pairs of sockets that can fire simultaneously, or they can be configured to fire separately by one or more triggering mechanisms.

The embodiment illustrated in FIGS. 8 and 9 includes a pair of upper sockets 30*a*, 30*b*, and a pair of lower sockets 30*a*', 30*b*' angled relative to one another at fixed angle "β." This fixed angle is generally set when forming the sockets within the projectile casing. In one aspect of the technology, however, the angle "β" can be variable, and can be adjusted by rotating one or both of the upper and lower sockets. One or both of the upper or lower pair of sockets can be coupled to a rotational device that rotates the sockets. For example, the sockets can be rotated into a generally parallel relationship, such as that shown in FIG. 10, or can be rotated so that the lower pair of sockets, in one example, is rotated downwardly relative to the launcher assembly.

This aspect of the technology can be advantageously incorporated into those embodiments in which the range finder 55 determines the distance the subject is from the launcher assembly. Once this distance is known, the lower pair of sockets 30*a*', 30*b*' can be automatically or manually adjusted into the proper downward trajectory. The user of the launcher assembly can then target the torso of the subject with the sight 52. As it is generally desirable to target the legs of the subject with the projectile launcher, the lower pair of sockets can be angled toward the legs of the subject even when the launcher is pointed at the subject's torso. In this manner, the launcher assembly can automatically or manually adjust for the proper trajectory of the entangling projectiles toward the subject, even when the launcher assembly is held relatively level with the horizontal.

Figure 10:
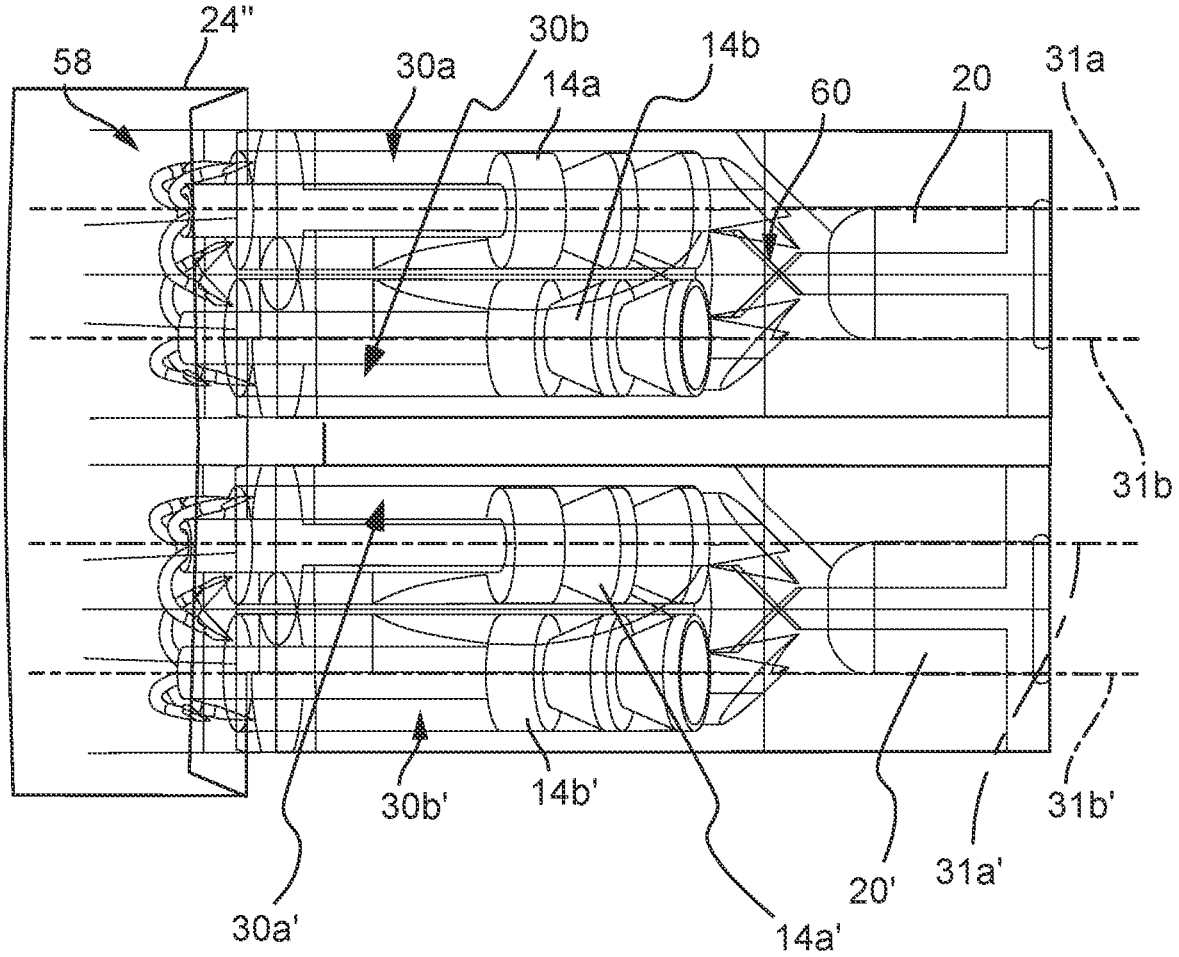
FIG. 10 is a side, partially sectioned view of a projectile casing in accordance with another embodiment of the invention.

FIG. 10 illustrates a further embodiment of the invention in which a casing 24" is configured very similarly to the casing 24 shown in FIGS. 1-3, 6 and 7. In this embodiment, however, the casing is configured to receive two entangling projectiles. Upper sockets 30*a* and 30*b* can receive therein pellets 14*a* and 14*b*, respectively, while lower sockets 30*a*' and 30*b*' can receive therein pellets 14*a*' and 14*b*', respectively. In the embodiment shown, each pair of sockets can have associated therewith a power or pressure source 20, 20', respectively.

An axis (31*a*, 31*b*) of at least one of the upper sockets 30*a*, 30*b* and an axis (31*a*', 31*b*') of at least one of the lower sockets 30*a*', 30*b*' can be angled relative to one another, analogously to the arrangement illustrated in FIG. 9. In one embodiment, however, the upper sockets and lower sockets can be arranged in a substantially parallel relationship. In other words, the angle "β" (FIG. 9) can be substantially zero. In this embodiment, the upper pair of sockets and the lower pair of sockets can be configured for sequential deployment toward the same general area of the subject (offset slightly by the difference in elevation of the upper and lower sockets). This embodiment can be beneficial in situations where a first deployment (or "wrap") was unsuccessful—as soon as this is apparent to the user, he or she can quickly deploy the remaining pair of pellets in substantially the same trajectory as the initial pair of pellets.

Returning to FIG. 4A, in one aspect the present technology provides a manner of initiating a power source, for example power source 20, via electronic ignition. In this aspect, power source 20 can comprise a "blank"—a cartridge that contains only powder, with no slug or projectile included in the cartridge. The primer (21 in FIG. 3) can be initiated by way of heat generation within the primer or cartridge. This heat generation can be initiated in a number of ways, but typically does not involve mechanical force. Contrary to conventional percussion primers, which ignite when impacted by a firing pin, electronic primer systems ignite when a particular heat level is reached within the primer. The heat can be generated electronically, by introducing a current into the primer, or by heating the primer with a device such as a laser. Such systems are sometimes referred to as "electronic firing pins."

In the present case, an initiator 70 can be carried by the launcher 10. The initiator can initiate firing of the power source 20 by either passing a current into the primer 21 of the power source, or by applying heat (by way of a laser, for example), which causes the primer to ignite. The primer then ignites the powder carried by the cartridge blank, in the same manner as percussion cartridges. A secondary power source, shown schematically at 20*g*, can comprise a battery or similar electrical storage device that provides power to the initiator.

This aspect of the invention can advantageously obviate the need for mechanical springs, "cocking" mechanisms, etc. This can save valuable space (or "real estate") within the launcher, and can avoid applying excessive mechanical shock to the components of the launcher(s). This aspect is particularly advantageous in those embodiments illustrated in FIGS. 8 through 10, in which multiple sets of projectiles are provided. The central control and power systems can be readily configured to allow an operator to very quickly switch between electronically firing a first projectile to electronically firing a second projectile, without having to physically manipulate any mechanical cocks or latches or springs associated with the second projectile.

In addition, as the initiator 70 is generally powered by an electronic storage device (e.g., a battery), use of electronic firing mechanisms herein can advantageously allow the use of a single power source, e.g., a single battery, to power the firing pins of the cartridges used for propelling the entangling projectiles, the laser or light targeting beam, the range finder, the CEW projectiles (both for firing and for application of current through the subject upon engaging the subject), etc.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

What is claimed is:

1. A near-range launcher assembly for at least temporarily detaining a subject, comprising:

a primary launcher, the primary launcher carrying a first projectile, the first projectile including a first pair of pellets and a first tether connecting the first pellets, the first projectile being capable of at least temporarily detaining a subject;

a secondary launcher carried with the primary launcher, the secondary launcher carrying a second projectile, the second projectile including a second pair of pellets and a second tether connecting the second pellets, the second projectile being capable of at least temporarily detaining a subject;

at least one power source, associated with one or both of the primary and secondary launchers;

at least one control system, operably coupled to the at least one power source, the control system operable to activate the power source;

at least one user input, operably coupled to the at least one control system, the user input operable to communicate with the control system based on input from the user to activate the at least one power source to expel one or both of the first projectile and the second projectile from the launchers toward the subject.

2. The assembly of claim 1, wherein each of the primary launcher and the secondary launcher carry an independent power source and control system, such that each of the primary and secondary launchers is independently operable by a user.

3. The assembly of claim 1, wherein the control system includes a single user input, the control system operable to activate either or both of the primary or secondary launchers in response to input from the user.

4. The assembly of claim 1, wherein at least one of the primary launcher and the secondary launcher are removably attached to a frame.

5. The assembly of claim 1, further comprising one or more sight generators carried by the launcher assembly, the one or more sight generators operable to generate a visible sight projectable on the subject.

6. The assembly of claim 5, wherein the one or more sight generators are capable of generating two distinct sight patterns, each distinct sight pattern associated with one of the primary or secondary launcher.

7. A near-range launcher assembly for at least temporarily detaining a subject, comprising:

a primary launcher carrying a first projectile, the first projectile including a pair of pellets and a tether connecting the pellets, the first projectile being capable of at least temporarily detaining a subject;

a secondary launcher coupled to the primary launcher, the secondary launcher carrying a second projectile, the second projectile being capable of at least temporarily detaining a subject;

at least one control system, operably coupled to one or more power sources, the control system operable to activate the one or more power sources; and at least one user input, operably coupled to the at least one control system, the user input operable to communicate with the control system to activate the one or more power sources to expel one or both of the first projectile and the second projectile from the launchers toward the subject; wherein each of the primary launcher and the secondary launcher carry an independent power source, such that each of the primary and secondary launchers can be independently initiated by a user.

8. The assembly of claim 7, wherein the one or more power sources comprise a blank cartridge having an electronically firing primer, and further comprising:

an initiator carried by one of the launchers, the initiator operable to initiate firing of the electronically firing primer to cause activation of the one or more power sources; and a secondary power source, operable to provide electric power to the initiator.

9. The assembly of claim 8, wherein the primary launcher and secondary launcher each carry a blank cartridge having an electronically firing primer.

10. The assembly of claim 7, further comprising one or more sight generators carried by the launcher assembly, the sight generator(s) operable to generate a visible sight projectable on the subject.

11. The assembly of claim 10, wherein the one or more sight generators are capable of generating two distinct sight patterns, each distinct sight pattern associated with one of the primary or secondary launcher.

12. The assembly of claim 7, wherein the second projectile includes a second pair of pellets and a second tether connecting the second pellets.

* * * * *